United States Patent [19]

Cain

[11] 4,213,489

[45] Jul. 22, 1980

[54] ONE-SPOT COKE QUENCH CAR COKE DISTRIBUTION SYSTEM

[75] Inventor: George R. Cain, Pittsburgh, Pa.

[73] Assignee: Koppers Company, Inc., Pittsburgh, Pa.

[21] Appl. No.: 2,321

[22] Filed: Jan. 10, 1979

Related U.S. Application Data

[63] Continuation of Ser. No. 834,125, Sep. 19, 1977, abandoned.

[51] Int. Cl.[3] ..... C10B 39/14

[52] U.S. Cl. ..... 141/70; 141/1; 141/11; 141/12; 201/39; 201/41; 202/227; 202/228; 202/263; 202/270

[58] Field of Search ..... 202/227, 228, 263, 270; 201/39, 41; 141/1, 11, 12, 70

[56] References Cited

U.S. PATENT DOCUMENTS

| | | | |
|---|---|---|---|
| 425,797 | 4/1890 | Hunt | 202/227 |
| 469,867 | 3/1892 | Osbourn | 202/227 |
| 469,868 | 3/1892 | Osbourn | 202/227 |
| 976,580 | 11/1910 | Krause | 202/227 |
| 1,006,281 | 10/1911 | Ries | 202/227 |
| 1,365,974 | 1/1921 | Flood et al. | 202/227 |
| 3,959,083 | 5/1976 | Goedde et al. | 202/227 X |
| 3,988,211 | 10/1976 | Lewandowski et al. | 202/227 |
| 4,053,068 | 10/1977 | Gidick | 202/262 X |

FOREIGN PATENT DOCUMENTS

| | | | |
|---|---|---|---|
| 208557 | 8/1924 | United Kingdom | 202/227 |
| 1391600 | 4/1975 | United Kingdom | 202/227 |

*Primary Examiner*—Barry S. Richman
*Attorney, Agent, or Firm*—R. Lawrence Sahr

[57] ABSTRACT

A one-spot coke quench car is provided with a coke pile dispersement means to evenly distribute the coke within the car to permit additional coke to be accommodated and as an aid in more uniform quenching. The car has a sloping conduit therein and an exterior water metering valve that is fluidly connected to a pressurized tank of water mounted on the quench car frame. A small quantity (about two gallons) of water is pressurized in the water metering valve which can be opened to allow the small quantity of water to flow immediately and almost instantaneously through the sloping conduit and into the pile of incandescent coke. The water suddenly flashes, explosively, into a large volume of steam, expanding rapidly to disperse the coke within the quench car so that it is more nearly level therein.

4 Claims, 7 Drawing Figures

ONE-SPOT COKE QUENCH CAR COKE DISTRIBUTION SYSTEM

This is a continuation of application Ser. No. 834,125, filed Sept. 19, 1977, and now abandoned.

BACKGROUND OF THE INVENTION

1. Field of the Invention

The present invention is generally directed to the production of coke in horizontal coke oven batteries and, specifically, to a coke quench car used to receive the incandescent coke pushed from a coke oven in a battery and to transport that coke to a water quenching station.

2. Description of the Prior Art

For many years, incandescent coke that was pushed from a coke oven battery was received in a sloped gondola-type open car. That car, along with the locomotive used to move it, traveled on tracks adjacent to and parallel with the coke side of the coke oven battery. One end of the car was positioned adjacent to an open coke oven. At a given signal, the coke was pushed by a pusher machine, located on the opposite side of the coke oven battery, into the quench car. When the coke began to fall from the coke guide, into the open car, the locomotive commenced to slowly move the open car past the open oven, thus, more or less, evenly dispersing the coke in that car. At the end of the push, the locomotive moved the open car to a quench station where the incandescent coke was drenched with water. From the quench station the open car was moved to a coke wharf where doors, on the side of the open car, were opened, allowing the coke to spill down the inclined bottom of the open car onto the wharf.

The major problem with this system was pollution. Large quantities of fumes, along with much particulate matter, escaped from the incandescent coke as it was pushed from the oven into the open car. Additional pollutants escaped as the open car was moved to the quench station. It was early recognized that means were needed to curtail this pollution.

Attempts were made to provide the open quench car with covers that would be closed when the car had been filled with coke. These attempts were partially successful in controlling the escape of pollutants while the quench car was being moved to the quenching station.

A fluid pumping and cleaning system was then added to the locomotive and connected to the gondola of the quench car. When the cover was closed, the pump would draw off the effervescing gases and particulate matter, clean it, and expel the cleaned medium to the atmosphere. This combination further curtailed the pollution while the quench car was being moved to the quenching station.

However, neither of these systems addressed the escape of pollutants, much greater in volume, incurred when the coke was being pushed into the quench car. One of the first systems to control this problem took the form of a large metal shed constructed over the entire coke side of the coke oven battery and over the tracks along which ran the locomotive and quench car. Large fans drew off the pollutants, cleaned them and expelled the cleaned medium into the atmosphere. The shed system was a great improvement but not entirely effective as it was open-ended, allowing the escape of a significant portion of the pollutants. Further, the shed system required large capital expenditure and expensive frequent maintenance.

Engineering thought, at this point, turned to the exploration of means to contain the push pollutants at the immediate area of the quench car and open coke oven. Hood means were developed, operable with quench car covers, which extended and retracted as the coke was moved through the coke oven, the idea being that the complete pushing operation would be ambiently enclosed, diverting all of the pollutants into a cleaning system. Such a system is disclosed in copending application Ser. No. 683,057 filed May 4, 1976, by Rogers and assigned to the assignee of this application.

However, it was recognized, in accordance with this invention, that the coke pushing pollutant problem could be better handled technologically if a quench car was not moved while the incandescent coke was being pushed into it. Technologically, one approach would be to provide a larger gondola for the quench car, able to contain the full charge of a single oven from a stationary, or one-spot, position. But in existing coke plants, this is difficult and occasionally not feasible due to space problems. Such an approach also presents a problem in that the degree of retained moisture in the coke would be increased if the coke was not evenly dispersed in the quench car during quenching. Using only a larger gondola also could result in a large mound of coke piled in the center of the gondola. An uneven large mound of coke would debilitate even cooling by way of quenching, due to the inability of the quench water to readily find its way to the center of the mound. Thus, for a quench car to remain stationary during the coke push, means need to be developed to evenly disperse the coke throughout the gondola. Further, to convert existing coke plants, space limitations need to be taken into consideration. The system of the present invention utilizes the existing general length, width and overall height constants of existing quench cars and their gondolas in a stationary or one-spot position, while containing the pollutants and evenly dispersing the incandescent coke therein.

SUMMARY OF THE INVENTION

The present invention provides a one-spot quench car, preferably with slidable top covers or the equivalent, operable in conjunction with a hood means and coke guide, which together totally enclose the pushing operation whereby coke is expelled from a coke oven into the one-spot quench car. Means for forcing a small quantity of water into the center core of the pile of incandescent coke is provided. In the preferred embodiment, a downwardly sloping conduit, positioned transversally within the receptacle of the quench car, has a pressurized water metering valve and chamber such that when the valve is opened, the water is instantaneously dispersed, through the sloping conduit, into the center of the mound of incandescent coke where the water is immediately and explosively flashed into steam, rapidly expands and disperses the coke, substantially leveling the coke in the quench car receptacle.

These and other features of the present invention will be more completely described and disclosed in the following specification, the accompanying drawings and the appended claims.

DETAILED DESCRIPTION OF THE PREFERRED EMBODIMENT

Figure 1:
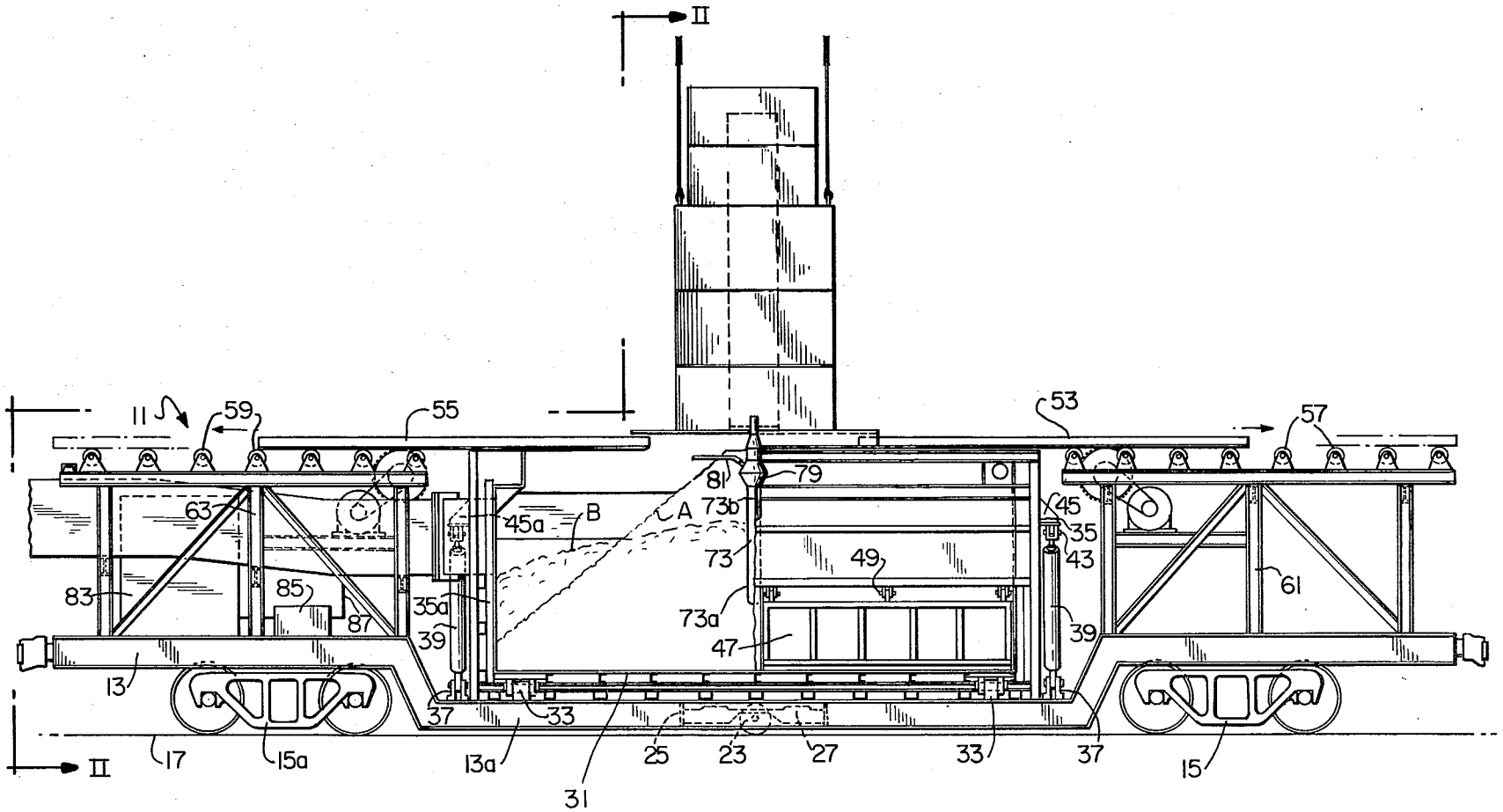
FIG. 1 is a schematic side elevational view, partially cut away, of a coke quenching car, as viewed looking toward the coke side of a coke oven battery, in accordance with the present invention.

Referring now to FIG. 1, a one-spot quench car 11 has slidable top covers 53, 55 operable in conjunction with a hood means 121 and a coke guide 119 which, together, totally enclose the pushing operation as coke is pushed from a coke oven 21 into quench car 11. Means for forcing a small quantity of water into the center core of the pile of incandescent coke is provided. In the preferred embodiment, a downwardly sloping conduit 73*a* is positioned transversally within the receptacle 31 of the quench car 11. A pressurized water metering valve 79 is connected to the downwardly sloping conduit 73*a* such that when water therein is released, the water is almost instantaneously dispersed through the downwardly sloping conduit 73*a* into the center of the mound of incandescent coke A where the water is explosively flashed into steam which then rapidly expands and disperses the coke, substantially leveling the coke, as shown at B, in the quench car receptacle 31.

Referring to FIG. 1, a coke quenching car 11 in accordance with the present invention comprises a car frame 13 having trucks 15, 15*a* at the front and rear ends, respectively, and a depressed middle section 13*a*. The front 15 and rear 15*a* trucks coact with rails 17, arranged along the coke side of a coke oven battery 19 in which there are a plurality of coke oven chambers 21. The depressed middle section 13*a* of the car frame 13 is provided with a pair of auxiliary rollers 23 that are mounted to supporting structure 25 carried by the frame 13*a*. The supporting structure 25 is resiliently mounted, as at 27, and the auxiliary rollers 23 coact with rails 17, as suggested in FIG. 2.

Figure 2:
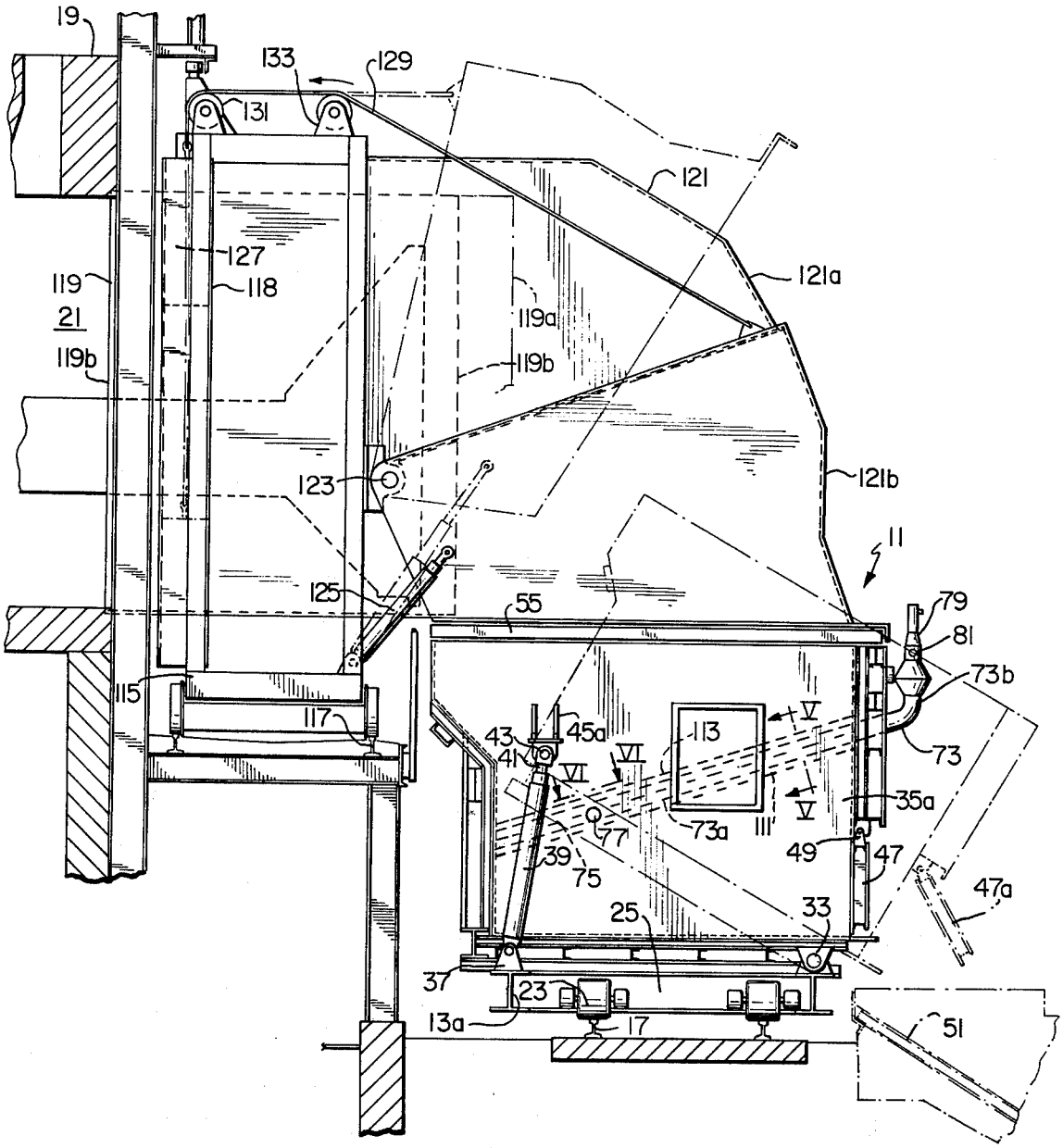
FIG. 2 is an end elevational view along line II—II of FIG. 1
Figure 3:
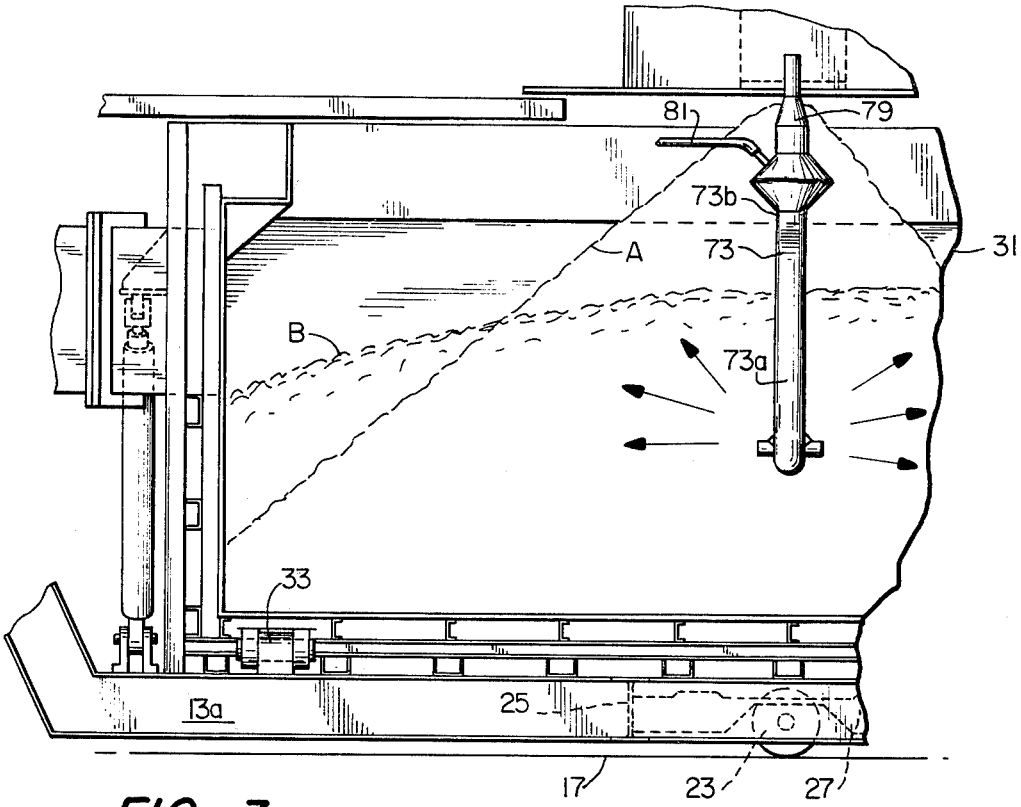
FIG. 3 is a view of a portion of the structure of FIG. 1, but on an enlarged scale.

As shown in FIGS. 1 and 2, pivotally supported on the depressed middle section 13*a* of the quenching car frame 13 is a coke receptacle 31 that has the general shape of a hollow parallelepiped with an open top. The bottom longitudinal edge of the receptacle 31, being the edge that is further away from the coke oven battery 19, supports a pair of hinges 33, which are mounted also to the mid-section 13*a* of the car frame 13. The hinges 33 are disposed adjacent to the front 35 and rear 35*a* end walls of the receptacle 31, as shown in FIG. 1.

The mid-section 13*a* of the car frame 13, at the front and rear end portions thereof, also support mountings 37 to which are pivotally connected cylinder-piston assemblies 39. The piston rod portion 41 of each cylinder-piston assembly 39 is pin connected, as at 43, to lugs 45, 45*a* mounted to the end walls 35, 35*a*, respectively. These cylinder-piston assemblies 39, together with the hinges 33, make it possible to pivot the coke receptacle 31 from the upright coke receiving position, shown in solid outline in FIG. 2, to an inclined coke discharging position, shown in phantom outline in FIG. 2.

The outer longitudinal wall of the coke receptacle 31, being the wall further away from the coke oven battery 19, is provided with a pair of hinged covers 47 over coke discharge ports in the outer wall. As shown in FIG. 2, these hinged covers 47 pivot about hinges 49 and open where the coke receptacle 31 pivots about hinges 33 to the position 47*a*, thus discharging the quenched coke onto a coke wharf 51.

After the incandescent coke gravitates into the coke receptacle 31, the open top of the coke receptacle 31 is covered by a pair of sliding covers 53, 55. Each sliding cover 53 and 55 is slidable on top of the coke receptacle on rollers 57, 59 or in any suitable manner.

The slidable covers 53, 55 shown in FIG. 1 are supported on the rollers 57, 59 which are mounted to structural supports 61, 63 fixed to the front and rear end portions (as viewed in FIG. 1) of the car frame 13.

As shown in FIGS. 1 and 2, the outer longitudinal wall of the coke receptacle 31 is pierced by, and supports, a conduit 73 that has a downwardly sloping portion 73*a* within the coke receptacle 31 and that has a vertical portion 73*b* outside of the coke receptacle 31.

Figure 6:
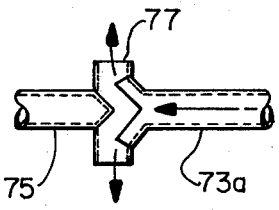
FIG. 6 is a view along line VI—VI of FIG. 2.

The lower end portion of the sloping conduit 73*a* (FIG. 6) connects to a transverse conduit 77, and this short transverse conduit is joined to a non-conductive tubular brace 75 that is secured to the inner wall of the coke receptacle 31.

Figure 4:
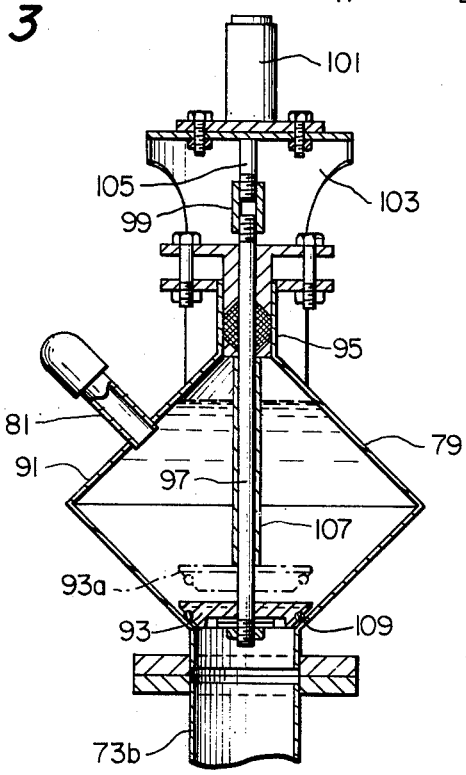
FIG. 4 is an end elevational sectional view of a water metering valve in accordance with the invention.
Figure 7:
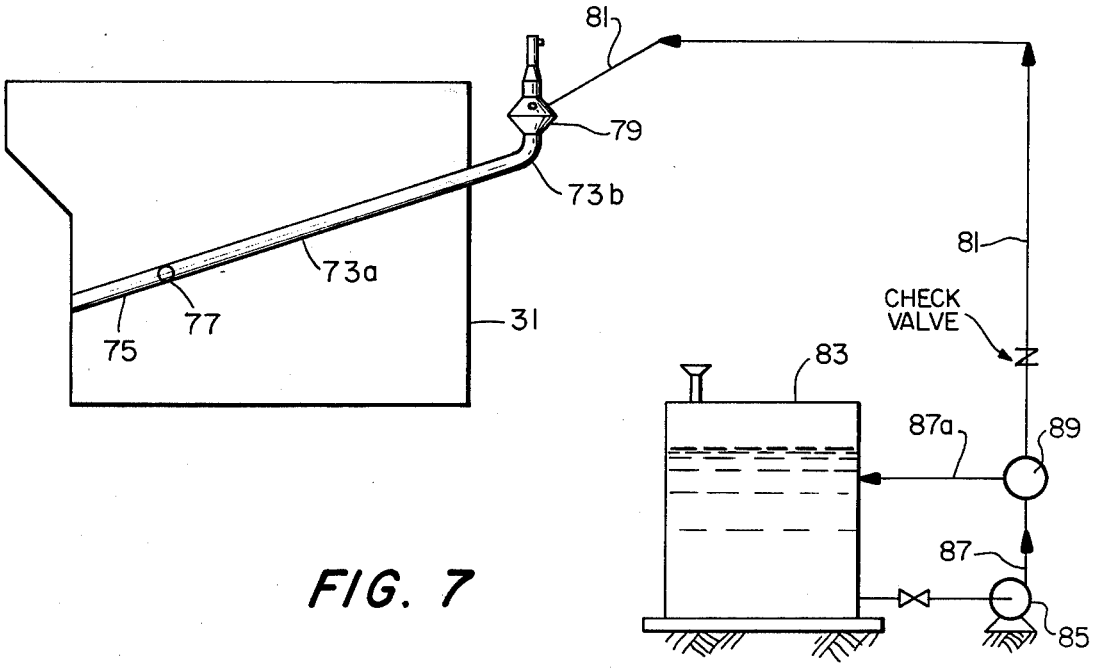
FIG. 7 is a schematic flow diagram of fluids in a system in accordance with the present invention.

Atop the vertical outer portion 73*b* is a water metering chamber 79, as shown in FIG. 4, into which water flows through a conduit 81. The conduit 81 is connected to a pressurized fluid receptacle or tank 83 conveniently mounted on the frame 13 about where shown in FIG. 1. As shown in FIG. 7, water in tank 83 is circulated in the system shown therein by a pump 85 which is fluidly connected to the tank 83 by means of piping 87 and through a pressure relief valve 89.

The water metering chamber 79 includes a container 91 shaped about as shown with a valve disc 93 disposed in the lower portion of the frusto-conical lower half of the container 91. The frusto-conical upper portion of the container 91 connects to a packing gland 95 of generally conventional form. A valve stem 97 is joined to a coupling 99 at the upper end, the valve stem 97 operating through the packing gland 95 in the usual reciprocal manner. Actuating means, such as an hydraulic actuator 101 of conventional form is mounted to the top of the container 91 by suitable supporting structure 103, and the output shaft 105 of the actuator 101 is also secured in the coupling 99.

Surrounding the valve stem 97 is a guide tube 107 which is fixed to the lower half of the packing gland 95 and which is of finite length, the length, as shown in FIG. 4, being such that when the valve disc 93 is raised to the open position 93*a*, the valve disc 93 abuts the end of the tube 107. The tube 107 acts then as a valve stop. As shown, the valve disc 93 is provided with an O-ring 109 on its periphery that forms a seal with the inner wall of the lower frusto-conical portion of the container 91.

Figure 5:
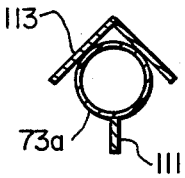
FIG. 5 is a sectional view along line V—V of FIG. 2.

As shown in FIG. 5, the inner portion 73*a* of conduit 73 is provided with a flat bar stiffener 111 on its bottom, and a protective angle 113 on its upper surface.

Associated with the coke quenching car 11, shown and described herein, is a conventional coke guide car 115 that travels on rails 117 disposed along the coke side of the battery 19. The coke guide car 115 carries structure 118 supporting a conventional coke guide 119 that is movable from an inoperative position 119*a* to an operative position 119b where the coke guide 119 abuts the face of the oven 21.

Mounted also on the structure 118 is a stationary portion 121a of a coke guide hood 121. A pivotable portion 121b of the coke guide hood 121 is pivotally mounted, as at 123, to the structure 118. The pivotable portion 121b of the coke guide hood 121 is actuated by cylinder-piston assemblies 125, on opposite sides of the hood 121.

As shown in FIG. 2, the pivotable portion 121b of the coke guide hood 121 is provided with a pair of counterweights 127 that are connected to wire rope cables 129 secured, as shown, to the pivotable hood portion 121b. The wire rope cables cooperate with guide pulleys 131 journaled in supports 133 mounted to the structure 118.

Referring to FIG. 7, the tank 83 contains a quantity of water, which quantity may be as much as 150 gallons. The tank 83 is connected to the pressure relief valve 89 through piping means 87 and pump 85, and through a return line 87a. The pressure relief valve is set at about 18 psi.

An object of the present invention is to inject a small metered quantity of water as nearly instantaneously as possible into the center core of a pile of recently pushed incandescent coke in the receptacle 31. The purpose to be accomplished is the more even distribution of the incandescent coke in a one-spot receiving car.

The pump 85 is operated to deliver the metered quantity of water (2 gallons) to the container 91. The volume of about 2 gallons of water comprises sufficient capacity of the container for each push of incandescent coke in the coke receptacle 31.

As the water rises in the container 91, the air above the water level in the container is compressed until the air pressure equals about 18 psi. When about 18 psi is achieved, the pressure relief valve 89 opens and the water in pipe 87 flows through line 87a back to the tank 83.

Those skilled in the art will understand that the preferred procedure for operating the coke quenching car of the present invention is as follows:

Initially, the coke quenching car 11, after having discharged quenched coke onto the coke wharf 51, is positioned and spotted at a selected oven chamber 21 to be pushed. The doors of the oven chamber 21 are removed, and the coke guide car 115 is positioned and spotted at the oven chamber 21. The sliding covers 53, 55 are moved toward each other from their positions over the structure 61, 63 at the ends of the car to the catch position, as shown in FIG. 1, leaving an opening about eight feet wide between the covers 53, 55. The pivotable portion of the hood 121b is then lowered to cover the opening between the covers 53, 55. Thereafter, the coke guide 119 is racked in from the stowed position 119a where shown in dotted outline in FIG. 2 to the operative position 119b abutting the face of the coke oven battery.

Then, when all is ready, coke is pushed from the oven chamber 21 through the coke guide 119 and hood 121 so that it gravitates into the coke receptacle 31 and forms a pile of incandescent coke having a profile like that shown by the letter A in FIG. 1.

After all of the incandescent coke gravitates into the coke receptacle 31, the hydraulic actuator 101 is actuated so that a slug of water (about two gallons) in the water metering chamber or container 91 is discharged through the sloping conduit 73a and into the pile of incandescent coke. The slug of water, as soon as it contacts the incandescent coke, immediately flashes into steam.

The result is that, because the steam forms so rapidly and at high pressure, it expands instantaneously into a large volume and disperses the incandescent coke above and on each side of the water discharge tubes. Then, the pile of incandescent coke assumes a profile similar to that designated by the letter B in FIG. 1, providing that additional coke can be accommodated as derived from the remaining portion or the push.

While no apparatus is shown to actuate the hydraulic actuator 101, those skilled in the art will know that any of several conventional apparatuses may be used, such as: (1) load cells on the coke receiving receptacle that would, as a preset load, send an electrical impulse to a solenoid that would open and allow fluid to flow to the hydraulic actuator; (2) a limit switch contacting the pusher ram which, when a preset stroke of the ram has been achieved, would send an electrical impulse to the aforementioned solenoid; and (3) a level sensor such as a gamma ray device, or laser beam, or the like, disposed in the coke receptacle that, when the pile of incandescent coke reaches a certain level, sends an electrical impulse to the aforementioned solenoid.

After the metered quantity of water has been discharged from the container 91, the hydraulic actuator 101 would be reactivated to close the valve disc 93 by using a timing device of known type. In any typical installation, the valve disc 93 would open and close within a period of about 5 seconds.

Thereafter the hood 121b can be raised; the sliding covers 53, 55 moved to close the opening; and the car 11 moved to the quenching station where the covers 53, 55 are withdrawn to completely open the car 11. The coke is quenched and the car 11 is then moved to the coke wharf 51 where the receptacle 31 is tilted and the coke is discharged onto the coke wharf 51. After discharging the quenched coke onto the wharf 51, the car 11 is ready to be positioned and spotted at the next oven to be pushed.

According to the provisions of the patent statutes, the principle of the present invention has been explained and the preferred construction and mode of operation have been illustrated and described in what is now considered to represent its best embodiment. However, it is to be understood that, within the scope of the appended claims, the invention may be practiced otherwise than as specifically illustrated and described.

What is claimed is:

1. A one-spot coke quench car comprising:

(a) a wheel-mounted frame;

(b) a receptacle mounted to said frame into which incandescent coke is pushed from a coke oven;

(c) at least one water metering storage chamber means, for containing a predetermined volume of water under pressure, juxtaposed to said receptacle, comprising:

(1) an upper frusto-conical portion open at both ends, (2) a lower frusto-conical portion open at both ends, fixed to said upper frusto-conical portion such that the larger diameters of said upper frusto-conical end portion and said lower frusto-conical end portion abut at the point of fixation to form a chamber having a central axis passing through the open smaller diameters of said upper frusto-conical portion and said lower frusto-conical portion;

(3) a valve disc positioned perpendicular to said central axis and disposed to seal the open smaller diameter of said lower frusto-conical portion;

(4) a valve stem, fixed to said valve disc, projecting through the open smaller diameter of said upper frusto-conical portion coaxial to said central axis;

(5) a packing gland sealing said smaller diameter of said upper frusto-conical portion around said stem such that said valve stem protrudes through said packing gland; and (6) inlet means through which water can enter said water metering storage chamber.

(d) pressurization means by which said predetermined volume is conveyed into said water metering storage chamber means and pressurized therein;

(e) discharge means by which said predetermined volume is released from said water meter storage chamber means;

(f) conduit means by which said predetermined volume is conveyed, after release, into the center core of said incandescent coke within said receptacle; and (g) dispersement means by which said predetermined volume is brought from said conduit means into direct contact with said center core of said incandescent coke within said receptacle, whereat said predetermined volume is rapidly and explosively converted into steam to disrupt and redistribute said incandescent coke within said receptacle prior to quenching.

2. A one-spot coke quench car as set forth in claim 1 wherein:

(a) said conduit means is a pipe, connected at one end to said smaller diameter of said lower frusto-conical portion, running through the central core of said incandescent coke within said quench car, and (b) said dispersement means is a transverse tube intersecting said pipe at said central core and having open ends through which said water is directed to said incandescent coke.

3. A one-spot coke quench car as set forth in claim 1 wherein:

(a) said pressurization means comprises a pump connected to said inlet means by piping; and (b) said discharge means comprises an actuating means operable to reciprocate said valve stem.

4. A one-spot coke quench car as set forth in claim 3 further comprising:

(a) a pressure relief valve interposed in said piping between said pump and said water metering chamber by which excess pressure within said water metering chamber can be released; and (b) a return line connected to said pressure relief valve to bleed off said released pressure.

* * * * *